United States Patent [19]

Itaya

[11] 4,289,004

[45] Sep. 15, 1981

[54] COIL SPRING MANUFACTURING MACHINE

[75] Inventor: Reijiro Itaya, Tokyo, Japan

[73] Assignee: Kabushiki Kaisha Itaya Seisaku Sho, Tokyo, Japan

[21] Appl. No.: 42,960

[22] Filed: May 29, 1979

[30] Foreign Application Priority Data

Feb. 19, 1979 [JP] Japan ..... 54-18109

[51] Int. Cl.[3] ..... B21F 3/04

[52] U.S. Cl. ..... 72/7; 72/138; 72/143; 140/92.2; 140/103

[58] Field of Search ..... 140/92, 103, 92.2; 72/137, 138, 142, 143, 135, 499, 7

[56] References Cited

U.S. PATENT DOCUMENTS

| | | | |
|---|---|---|---|
| 3,433,041 | 3/1969 | Cavagnero et al. | 72/138 |
| 3,563,283 | 2/1971 | Tufektshiev | 140/71 |
| 3,906,766 | 9/1975 | Sato | 72/12 |
| 4,030,327 | 6/1977 | Collins et al. | 72/23 |
| 4,064,732 | 12/1977 | Matsvoka | 72/142 X |
| 4,112,721 | 9/1978 | Takase et al. | 72/138 X |

OTHER PUBLICATIONS

Electronic Control of Wire Forming by S. Brym, *Springs,* May, 1969, pp. 21–25.

*Primary Examiner*—Nicholas P. Godici
*Assistant Examiner*—C. J. Arbes
*Attorney, Agent, or Firm*—Bernard Malina

[57] ABSTRACT

A coil spring manufacturing machine which is controlled by a micro-computer is described. Driving source of the coil spring manufacturing machine is a single motor. The power is divided into two independently controllable operation transmitting systems by a power dividing means. The one operation transmitting system transmits rotation to a mandrel assembly for winding a coil around a mandrel. The other operation transmitting system transmits a pitch movement to the mandrel assembly. Machining tools for the formation of coil spring legs are positioned around the mandrel assembly.

4 Claims, 15 Drawing Figures

18
19
20
21
22
23
24
25
26
27
28
29
29
29H
30
31
32
33
34
35
36
37
38
39
40
41
42
43
44
45
46
47
47'
48
48A
49
49A
49B
49C
C

FIG. 5
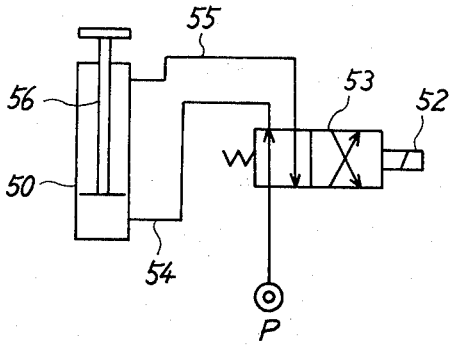
FIG. 6
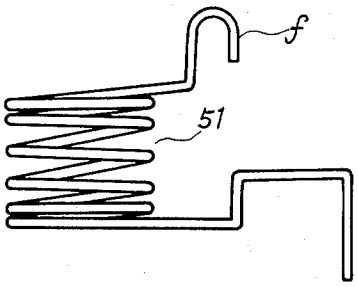
FIG. 7①
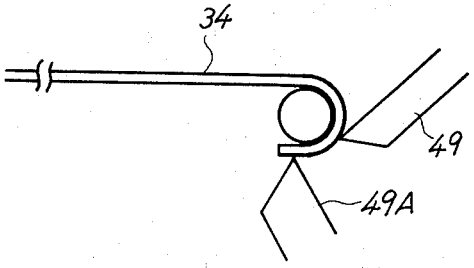
FIG. 7③
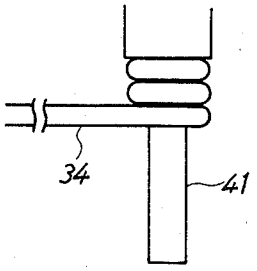
FIG. 7②
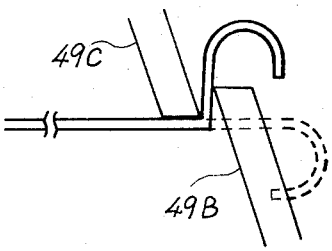
FIG. 7④
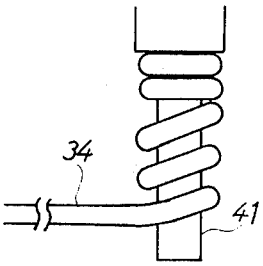

FIG. 7⑤
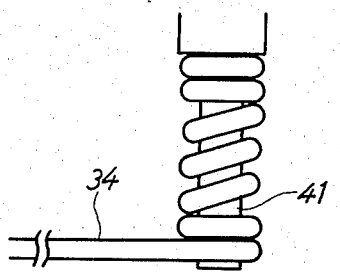
FIG. 8
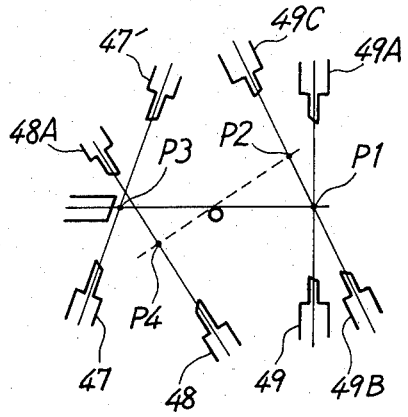
FIG. 7⑥
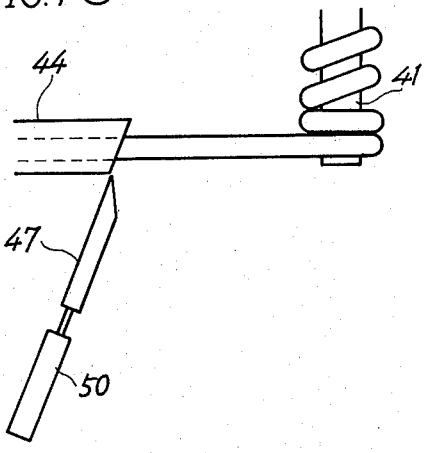
FIG. 7⑧
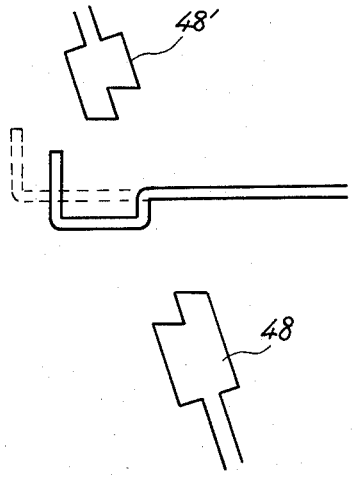
FIG. 7⑦
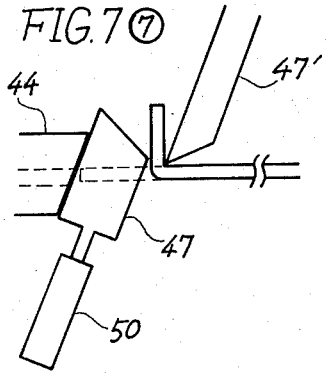

COIL SPRING MANUFACTURING MACHINE

BACKGROUND OF THE INVENTION

This invention relates to a coil spring manufacturing machine which is controlled by a digital computer.

Old type coil spring manufacturing machines were constructed by machinery elements. Although, through progress of the electric industry, an invention has been created which detects the number of windings to utilize the detection output for controlling a coil spring sequence circuit of the manufacturing machine.

Japanese patent application No. 42-65018 discloses an invention which provides cam switches and counters which control a magnetic clutch and brake and provides a plurality of motors for effecting the feeding of wire, rotating a mandrel to introduce a pitch to the coil spring and also introducing a back ring to the fully wound coil spring is carried out by operation from the motors. It is possible to form many types of coil springs, but in the course of preparation for starting an actual job for manufacturing coil springs, it is very complicated to change the operating position and to specify the operating position of the cam switch for adjusting same for formation of the coil spring which is proposed for manufacture. In addition, conventional coil spring machines are obliged to be enlarged in size due to same being provided with a plurality of motors. In recent years, through progress of the electronic industry, commercially supplied micro-computers which may control all the actions and operations of coil spring manufacturing machines in accordance with a program stored in a memory for formation into the desired forms of coil springs have been used. However, a coil spring manufacturing machine simplified in it's mechanical construction, utilizing a single drive motor and having a function for forming many types of coil springs has not been designed.

SUMMARY OF THE INVENTION

An object of the present invention is to provide a computer controlled coil spring manufacturing machine which affords a flexibility in its function and operation.

Another object of the present invention is to provide a coil spring manufacturing machine which is equipped with a mandrel having a function whereby rotation for winding and vertical movement for introducing pitches to coil springs are carried out independently without interference with each motion.

A further object of the present invention is to provide a coil spring manufacturing machine which is capable of carying out, in a short time, preparation for manufacturing a desired type of coil spring.

Still another object of the present invention is to provide a coil spring manufacturing machine which utilizes a sole driving source.

A still further object of the present invention is to provide a coil spring manufacturing machine which is simplified in its power transmitting mechanism.

A still further object of the present invention is to provide a coil spring manufacturing machine which is capable of manufacturing coils having specific configurations which cannot be manufactured by conventional machines.

These and many other objects, features and advantages of the present invention will become apparent as the description proceeds when taken into consideration with the accompanying drawings in which:

FIG. 5 is a block diagram illustrating an air cylinder driving system which is used in the present invention;

FIG. 6 is a perspective view of a coil spring as one of the examples which may be manufactured according to the present invention;

FIG. 7(1) to FIG. 7(8) are explanatory views for showing procedures for manufacturing the coil spring shown in FIG. 6; and FIG. 8 is an explanatory view illustrating the sequence of machinings.

PREFERRED EMBODIMENT OF THE INVENTION

Figure 1:
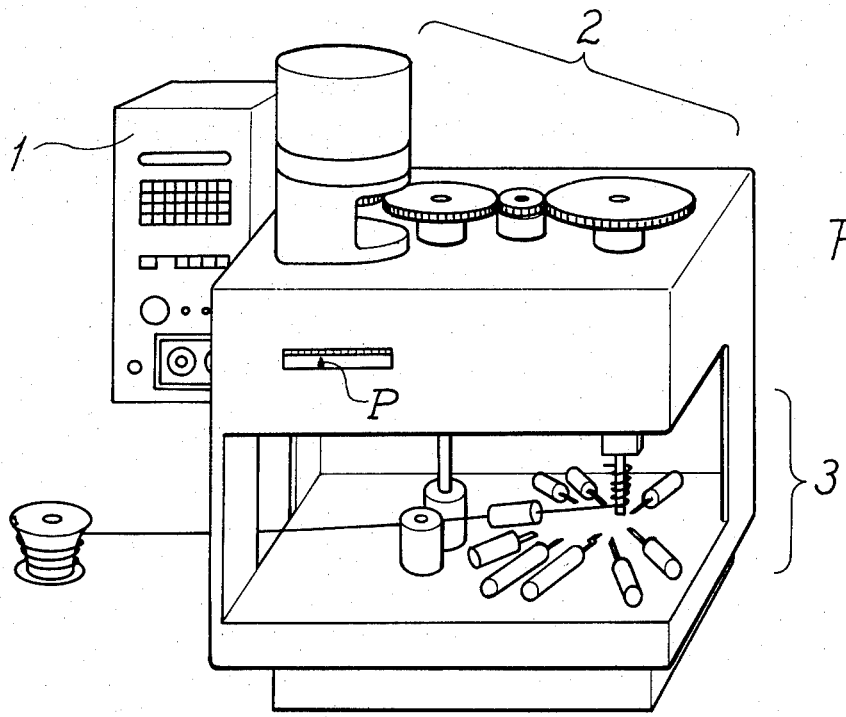
FIG. 1 is a perspective view illustrating the basic construction of the present invention.

A general construction of a coil spring manufacturing machine is shown in FIG. 1. The coil spring manufacturing machine comprises a control unit having a micro-computer, memory and keyboard, power transmitting assembly 2 provided with a motor and coil winding assembly 3.

Figure 2:
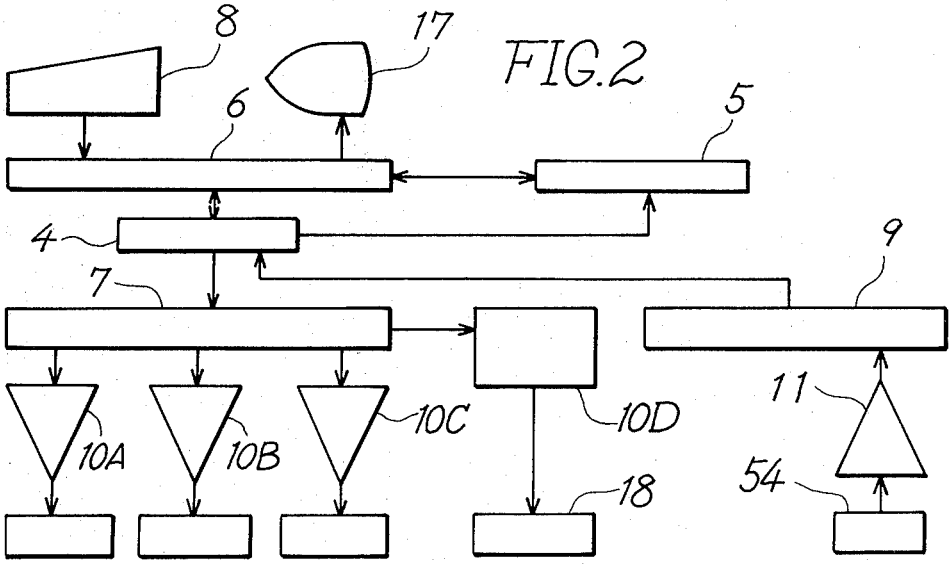
FIG. 2 is a block diagram illustrating an electronic construction of the present invention.

Prior to the detailed description of the machine construction of the present invention, a system structure of the invention will be described referring to FIG. 2.

A keyboard 8 is an input means for the machine. Instructions for starting and stopping the machine, parameters and commands, which include numbers of machinings of the coil spring, numbers of windings, figures of front and rear legs, are inputted by the keyboard 8 with monitoring by CRT 17. An output interface 7 transduces the output of micro-computer 4 to control magnetic clutch control driver 10A, brake control driver 10B and air cylinder control driver 10C. The output of micro-computor 4 is fed to pulse motor control driver 10D through the output interface 7. The output of start position detector 54 is supplied to an input interface 9 through an amplifier 11 and then supplied to micro-computer 4.

A memory 5 stores programs and parameters for controlling the micro-computer. A control program for the machine may be loaded from a read only memory (ROM) which is previously written in the program and is set into the memory. Also it is possible to input programs and parameters by keyboard 8 to memory 5. Further, it would be possible to read programs and/or parameters from paper tape, magnetic tape, magnetic disk or floppy disk.

Now, the power transmitting assembly will be described in detail.

Figure 3:
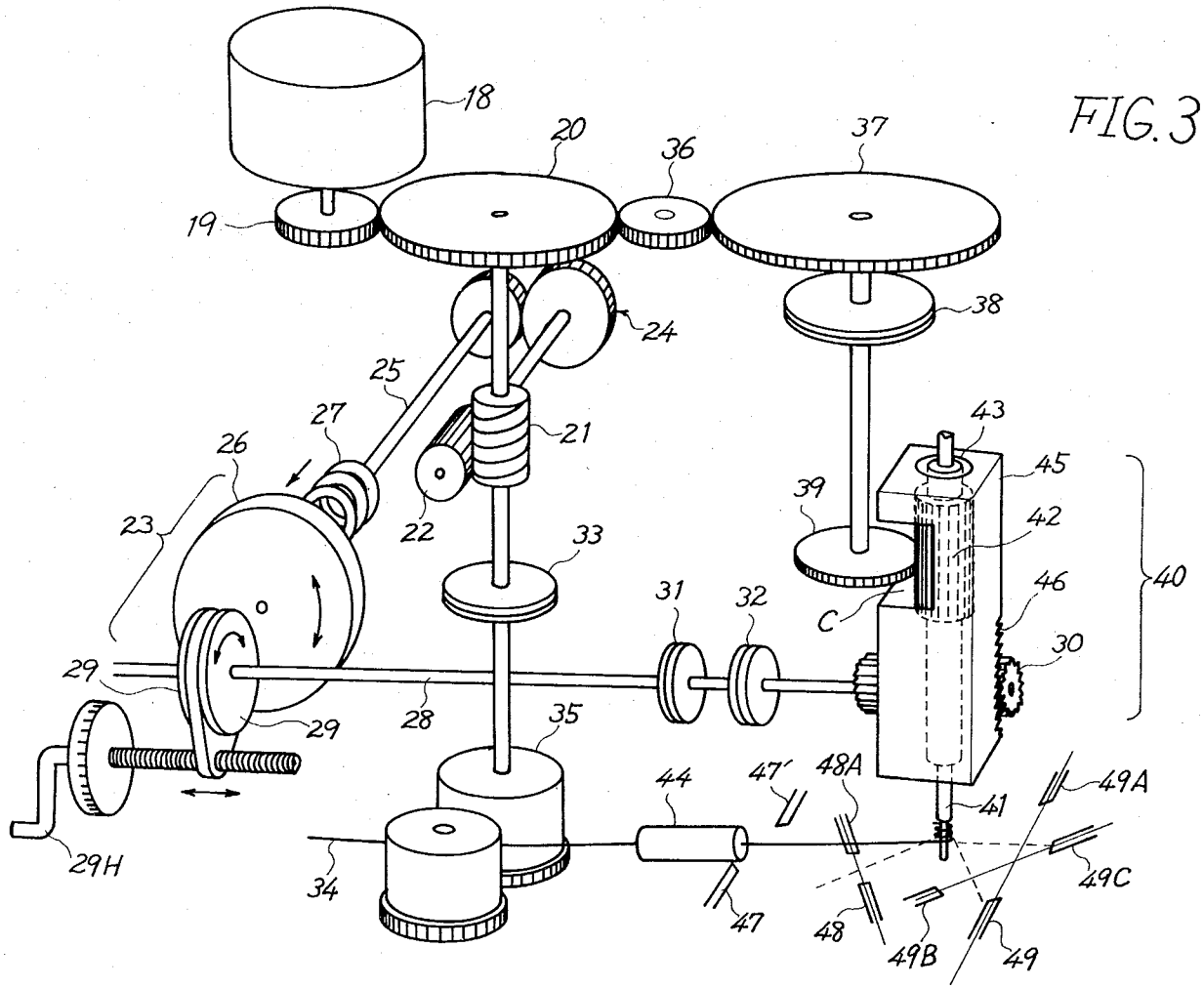
FIG. 3 is a perspective view of a power transmitting assembly of the present invention.

In FIG. 3, the reference numeral 18 indicates a pulse motor. A rotation of pulse motor is transmitted to two driving systems through output gear 19. One driving system comprises worm 21, worm wheel 22 and a pair of spur gear 24 which transmit the driving power to a stepless speed changing device which comprises a spring 27 wound around a shaft 25 and pushes a disk 26, one of the elements of the stepless speed changing device, to frictionally engage with a disk 29 provided on a shaft 28. Thus, the rotation of the disk 26 is transmitted to a pinion gear 30 via disk 29, shaft 28 and clutch 31.

The contact point of disk 29 with disk 26 is changed by a rotation of handle 29H. The rotation of handle 29H changes the transmission rate of disk 29 to disk 26. Thus, the pitch movement can be adjusted by manipulation of the handle 29H. The transmission ratio is indicated by an indicator P which is integrally mounted on a bearing block of disk 29. A shaft 28 is provided with a pinion gear 30 at its end. The reference numeral 31 is a magnetic clutch which is controlled by micro-computer 4 in order to transmit rotation of the shaft 28 to pinion gear 30 or cease rotation thereof. The reference numeral 32 indicates a magnetic brake which is controlled by micro-computer 4.

The rotation of gear 20 is transmitted to feed roll 35, through micro-computer controlled magnetic clutch 33, which feeds a wire 34. Also, the rotation of pulse motor 18 is transmitted to gear 37 through gear 36 and the rotation of gear 37 is transmitted to a gear 39 through magnetic clutch 38 which is controlled by micro-computer 4.

The movement of gear 39 rotates a mandrel 41 for winding the wire therearound. A mandrel assembly 40 performs machining for winding the wire around the mandrel 41 for coil spring formation and is designed so as to be capable of performing a vertical movement (up and down) independent of rotation of the mandrel in order to perform the machinings of the front and rear legs of the coil spring.

Figure 4:
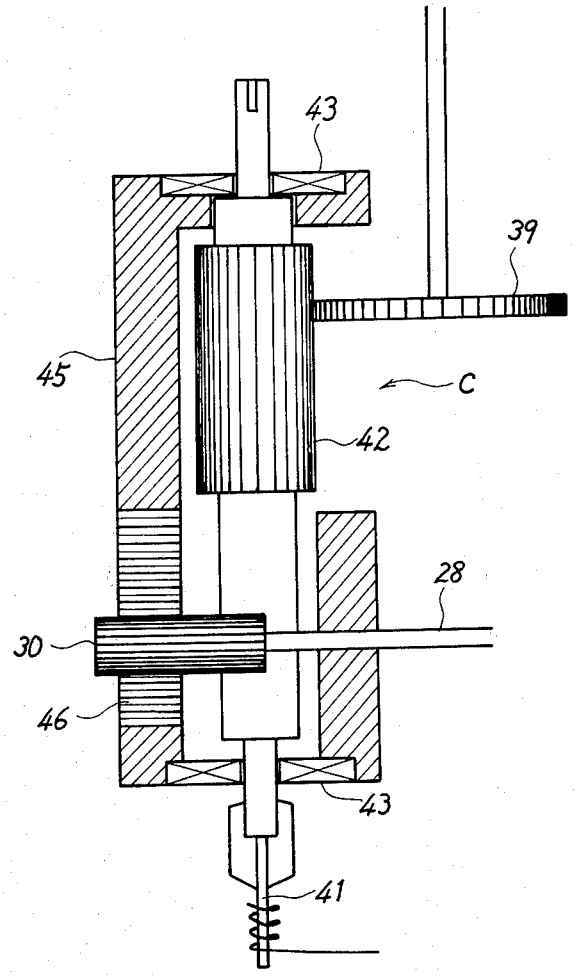
FIG. 4 is a rear elevation, with parts partially in cross section, of a mandrel assembly.

In detail, the mandrel 41 is integrally provided with a vertically elongated gear 42 which is rotatably received within bearing block 43 at both end portions of an outer frame 45 of the mandrel assembly 40. A rack 46 is provided on an outer face of the outer frame 45 and is allowed to move in an up and down motion by a pinion gear 30. Due to the construction mentioned above, the mandrel 41 is allowed to move upward and downward even if the mandrel 41 is in a rotation mode or while not rotating. The longitudinal gear 42 is slidingly engaged with a gear 39 to allow the gear to slip on the gear 42 in accordance with the upward and downward movements of the outer frame 45. As illustrated in FIG. 4, the outer frame 45 is provided with an opening C so as to allow the longitudinal gear 42 to be engaged with the gear 39 during the vertical movement of the mandrel assembly 40. Also, the rack 46, provided on the outer frame 45, is engaged with the pinion gear 30 and due to this engagement, the rotation of the pinion gear 30 moves the rack 46 and outer frame 45 upward and downward. From the foregoing, it is apparent that the mandrel 41 moves downward and upward in accordance with the movement of the outer frame 45.

A reference numeral 47 indicates a cutter for cutting the wire 34 and reference numeral 47' indicates a machining tool for machining the rear legs of the coil springs. Reference numerals 49, 49A, 49B and 49C, respectively, indicate machining tools for machining front legs of the coil springs. These machining tools are actuated by air cylinders 50 illustrated in FIG. 5. When an output of the driver 10C is supplied to a solenoid 52 of a magnetic valve 53, pressurized air from an air source is supplied to one chamber of air cylinder 50 through tube 54 to push the tool provided at an end of a piston rod 56 for carrying out the machining. Each air cylinder, respectively, is provided with machining tools 47 to 49.

The solenoid 52 maintains its energized condition during the time it takes to carry out machining by control of micro-computer 4.

Upon completion of bending a leg of the coil spring, the supply of power to the solenoid 52 is set on pause and the magnetic valve 53 is switched. Thus, pressurized air is supplied through tube 55 to the other chamber of the air cylinder 50 and pushes the piston down.

The operation of the coil manufacturing machine will now be exlained.

After completion of the inputting programs by keyboard 8 and the machine has received instructions to start, the pulse motor 18 rotates to the extent corresponding to the number of given pulses and the output gear 19 and the gear 20 engage with the output gear 19 are driven. This drive is transmitted to the feeding roller 35 through magnetic clutch 33. When the feeding roller 35 rotates, the wire 34 is fed with a minimum increment of 0.1 mm.

When the wire 34 is fed to the area of mandrel 41, the wire 34 is clipped by a conventional means (not shown in the drawings) provided on the mandrel 41 and the machining tools 49 and 49A are actuated so as to carry out the bending for formation of the front leg of the coil spring. An operating point of the machining tools 49 and 49A is indicated at point P1. Then, the power by the rotation of the pulse motor 18 is fed to the mandrel 41 and rotates the mandrel 41 through gear 20, 36 and 37 under the control of magnetic clutch 38.

The degree of rotation of mandrel 41 is determined by the number of pulses supplied to the pulse motor 18 under the control of the micro-computer 4. The top of the wire 34 is automatically faced, by rotation at the machining stage, toward the second front leg, machining tools 49B and 49C, the air cylinder 50 actuate for operating the machining tools 49B and 49C in order to form the front leg of the coil spring. An operating point of the machining tools 49B and 49C is indicated at point P2. As occasion demands, it is possible to utiliize a number of machining tools which are positioned around the mandrel at predetermined distances for carrying out the machining in sequence and in accordance with rotation of the mandrel assembly 40.

In this construction, there is a possibility that the mandrel assembly 40 is unable to rotatably move to the next machining position due to the obstruction by the machining tools. In order to solve this obstruction, an instruction for enabling the magnetic clutch 31 to operate is supplied to the magnetic clutch 31 and then other instructions for disenabling the brake 32 from operating is supplied to the magnetic brake 32 by the control of micro-computer 4 for releasing the magnetic brake 32 in order to rotate the pinion gear 30 engaged with the rack 46. After moving the mandrel assembly 40 upward to the desired height, the mandrel 41 is rotated to move the coil spring to the next machining position without any obstruction by the machining tools and then the mandrel 41 moves downward for carrying out the machining by reverse rotation of pinion gear 30. After rotating the mandrel 41 for a predetermined number of rotations for winding the wire 34, the mandrel 41 is reversely rotated for preventing the coil spring from uncoiling. Then, cutter 47 and machining tool 47' are actuated at an operating point P3 to cut and carry out machining for formation of the rear leg of the coil spring. It is, of course, possible to conduct a plurality of machinings to the rear leg by providing a number of machining tools in the same manner as the machinings for the front leg. Upon completion of the machining, a formed coil spring is released from the mandrel 41 where the coil spring is clipped by conventional clipping means (not shown in the attached drawings).

Now, the procedure for manufacturing the coil spring will be explained in detail referring to the actions of the mandrel assembly 40 and FIGS. 6 and 7. The coil spring which is manufactured by the above-mentioned procedure is the type of coil spring shown in FIG. 6. The tools for effecting machining of the coil spring 51 are positioned on a plane within the area of 360° centered around the mandrel assembly 40 and operating points P1 to P4 of those machining tools are positioned within a perpendicular area of mandrel assembly 40.

When the wire 34 is fed to the machining area, the first machining procedure is carried out for forming a hook part f of the coil spring by bending the front part of the wire 34 in a counter clockwise direction by actuation of bending tools 49 and 49A. Then the hook part f is faced toward a position where the hook part f is bent by the second bending tools 49B and 49C and the hook part f is completely formed into the shape shown in FIG. 7(2). As shown in FIG. 7(3), the pitch spacing of the coil spring 51 is put tightly together at the start position. After the tight pitches are formed round the mandrel 41, pitch movement with large pitch spacing are introduced under control of the micro-computer 4 by actuating the magnetic clutch 31 and releasing the magnetic brake 32 to permit the pinion gear 30 to rotate for moving the mandrel assembly 40 upward. Pitch spacing shown in FIG. 7(4) is obtained by those pitch movements. At the time when the predetermined number of windings with large pitch spacing are completed, micro-computer 4 sends an instruction for releasing the magnetic clutch 31 and actuating the brake 32. Thus, the pitch movements are stopped and the mandrel 41 is rotated only for putting the pitches tightly together as shown in FIG. 7(5). When winding has been completed, the mandrel 41 is reversely rotated for preventing the coil spring from uncoiling, and then the wire 34 is cut by cutter 47 and the machining for forming the front leg is simultaneously carried out by cooperation of the cutter 47 and tool 47' (FIG. 7(7)).

Since the operation for moving the coil spring to the second machining stage from the first machining stage is interrupted by the cutter 47 and machining tool 47', it is necessary to move the mandrel assembly 40 upward for lifting the coil spring to the second machining stage. After the coil spring 51 is shifted to the second machining stage, the mandrel 41 is moved downward so as to actuate machining by machining tools 48 and 48A for carrying out the second machining of the rear leg (FIG. 7(8)). An operating point of machining tools 48 and 48A is indicated at point P4. When all procedures mentioned above have been carried out, the clipping means (not shown in the attached drawings) for clipping the coil spring 51 is released and the coil spring falls. By utilizing the foregoing procedures, when one coil spring is completely formed, the mandrel 41 is further rotated to return same to its starting position in order to commence formation of a subsequent coil spring. Return to the start position is detected by the start position detector 54 by detecting a magnet which is provided on the mandrel 41. Start position detection may utilize conventional skills such as photo-electronic detection means.

For understanding the procedures for formation of the coil springs, respective procedures can be listed up as follows.

Step 1 feeding wire
Step 2 machining of front leg at point P1
Step 3 move mandrel assembly upward
Step 4 rotation of mandrel assembly
Step 5 move mandrel assembly downward
Step 6 second machining of front leg at point P2
Step 7 rotation of mandrel and pitch movement of mandrel assembly
Step 8 reverse rotation of mandrel
Step 9 cutting wire and first machining of rear leg at point P3
Step 10 move mandrel assembly upward
Step 11 rotation of mandrel
Step 12 move mandrel downward
Step 13 second machining of rear leg at point P4
Step 14 return mandrel to start position
Step 15 coil spring falls
return to the first step In this invention, as programs are fed to memory banks through the keyboard to control the magnetic clutch, magnetic brake and air cylinder, it is possible to manufacture coil springs of complicated configurations. Further, it is possible to precisely adjust the pitch movement to employ the stepless speed changing device which is coupled to a handle for adjusting pitch movement.

In addition, it is apparent that the present invention can be embodied with the pitch movement using simple construction of the pinion gear being coupled to the stepless speed changing device through the magnetic clutch and magnetic brake and is engaged with the rack so as to move the mandrel assembly upward and downward.

As many apparently widely different embodiments of this invention may be made without departing from the spirit and scope thereof, it is to be understood that the invention is not limited to the specific embodiments thereof except as defined in the appended claims.

I claim:

1. A computer controlled apparatus for producing coil springs comprising computer means, wire supply means, a single driving motor, a drivable winding mandrel movable axially for pitch setting, an axially elongated gear for axially supporting said mandrel, a first gear unit including a first gear, second and third gear units with each of said gear units being provided a magnetic clutch, said driving motor being operationally coupled with said axially elongated gear for rotatably supporting said mandrel through said first gear unit, and an axial gear for axially moving said mandrel through said second gear unit, said wire supply means being operative to supply wire through said third gear unit and said magnetic clutches are operative in response to said computer means for controlling said first, second and third gear units respectively.

2. A computer controlled apparatus as claimed in claim 1 wherein said first gear unit comprises a first gear and including a frame for rotatably supporting said mandrel and having an elongated opening, said frame having a rack on the exterior thereof for engaging said first gear, whereby said single driving motor causes said wire to be wound and the pitch thereof controlled independently and simultaneously.

3. A computer controlled apparatus as claimed in claim 2, including machinery tools for formation of front and rear legs of coil springs are provided centered about said mandrel.

4. A computer controlled apparatus as claimed in claim 3, wherein an operating point of said machinery tools is within the perpendicular area of said mandrel.

* * * * *